US008490617B2

(12) United States Patent
Vacca et al.

(10) Patent No.: US 8,490,617 B2
(45) Date of Patent: Jul. 23, 2013

(54) JET CAVITY CATALYTIC HEATER

(75) Inventors: Giampaolo Vacca, Mason, OH (US); Jeffrey Poston, Mason, OH (US); Michael A. Swank, Mason, OH (US); Robert Glenn Hockaday, Los Alamos, NM (US); Lawrence Weber, Holbrook, NY (US); Pavlo Bagriy, Mason, OH (US)

(73) Assignee: GHT Global Heating Technologies, GmbH, Baar (CH)

( * ) Notice: Subject to any disclaimer, the term of this patent is extended or adjusted under 35 U.S.C. 154(b) by 834 days.

(21) Appl. No.: 12/647,834

(22) Filed: Dec. 28, 2009

(65) Prior Publication Data

US 2010/0192937 A1 Aug. 5, 2010

Related U.S. Application Data

(60) Provisional application No. 61/140,902, filed on Dec. 26, 2008.

(51) Int. Cl.
*F24J 1/00* (2006.01)

(52) U.S. Cl.
USPC ..... 126/263.01; 126/91 A; 431/7; 431/268; 431/170; 431/11; 431/258; 422/159; 422/168; 48/197 R

(58) Field of Classification Search
USPC ..... 126/263.01, 91 A; 431/7, 268, 170, 431/208, 11, 258, 328, 215, 246; 422/159, 422/168; 48/197 R
See application file for complete search history.

(56) References Cited

U.S. PATENT DOCUMENTS

| | | | | |
|---|---|---|---|---|
| 4,029,636 | A | 6/1977 | Lowry et al. | |
| 5,087,270 | A * | 2/1992 | Gateau et al. | 48/127.9 |
| 5,368,475 | A | 11/1994 | Suppiah et al. | |
| 6,358,640 | B1 * | 3/2002 | Kendall et al. | 429/434 |
| 6,620,386 | B1 * | 9/2003 | Welch | 422/607 |
| 6,709,264 | B2 * | 3/2004 | Hermann et al. | 431/170 |
| 2004/0134200 | A1 | 7/2004 | Schroeder et al. | |
| 2004/0209206 | A1 | 10/2004 | Hockaday et al. | |
| 2005/0106429 | A1 | 5/2005 | Keefer | |
| 2006/0154190 | A1 | 7/2006 | Reiser et al. | |
| 2008/0044781 | A1 | 2/2008 | Stolyarenko et al. | |

* cited by examiner

*Primary Examiner* — Avinash Savani
(74) *Attorney, Agent, or Firm* — Jenei LLC

(57) ABSTRACT

The present invention is a method of delivering vaporized alcohol fuel through a thermally conductive porous nozzle to a catalytic burner with a plasma cavity and a surrounding porous catalytic cavity with fuel vapor and air supplied separately and inter diffusing into each other from different routes to the catalyst to achieve an efficient, steady, and complete combustion of the hydrogen bearing fuels. This heating system with passive auto thermostatic behavior, coupled to thermopiles, heat pipes and fluid heating systems may provide useful heat and electricity to applications of floors, roadways, runways, electronics, refrigerators, machinery, automobiles, structures, and fuel cells.

31 Claims, 7 Drawing Sheets

JET CAVITY CATALYTIC HEATER

CROSS-REFERENCE TO RELATED APPLICATION

The present invention claims priority to provisional U.S. Patent Application No. 61/140,902 as filed on Dec. 26, 2008.

STATEMENT REGARDING FEDERALLY SPONSORED RESEARCH

Not applicable.

NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND ON THE INVENTION

1. Field of the Invention

The present invention relates generally to heating systems, and more particularly to catalytic heating systems that generate heat and electricity via an oxidation reaction within a cavity having porous catalytic walls.

2. Description of the Related Art

The early inventions of liquid fueled heating systems include the oil lamp and the candle. Each early liquid fueled heating system wicks fuel up to a region where the fuel could evaporate and combust. Oils and kerosene lanterns can use the wick directly. Alcohol burners, and in particular methanol burners, need an added thermal conductor and sleeve tube to the wick in order to deliver enough heat to pre-heat the fuel and channel vaporized fuel to the burn zone. Without such thermal conductor and sleeve tube around the alcohol burners, the fuel, the flame front, or plasma burns the associated wick.

Recently a need to cleanly burn alcohols rather than other hydrocarbons such as, for example, oils and kerosene, has arisen. Such alcohols can be derived from waste materials, also known as "biomass," or manufactured from "alternative energy" sources.

There are several advantages for burning alcohols rather than hydrocarbons. For example, methanol burns without, smoke, soot and odors. Alcohol fuels, in contrast to kerosene, burn cooler and can be extinguished with water. Methanol and the alcohols will self start catalytic combustion on suitable catalysts and produce substantially complete combustion. Catalytic hydrocarbon burners, on the other hand, generally require a preheating step for the catalyst. Such advantages in burning alcohols, rather than hydrocarbons, allow for low cost and fuel effective heaters.

In view of the forgoing, the various exemplary embodiments of the present invention achieve an efficient combustion heater and heat transfer for space heating. Other various and similar applications could arise out of the exemplary embodiments of the present invention as well.

The mechanism of diffusing fuel and air from separate routes into the fuel, rather than mixing the air and fuel together and then arriving at the catalyst, results in a significantly improved combustion situation.

Conventional burners that mix fuel and air together for combustion within a cavity can lead to unsteady and explosive burns of the fuel and air. Typically, the larger the cavity of the conventional burner, the larger the associated explosion. This can lead to burner fatigue and disastrous results such as, for example, rupture of the heater.

It has been found that fuel air mixtures can vary in time which may lead to flame front loss and explosions when re-establishing the flame. This is a particular problem in burning of tail gasses from refineries or catalytic reaction systems of two streams of reactants.

To avoid such possible disasters, in various exemplary embodiments of the present invention, fuel and air are separated by a porous catalytic bed. The fuel and air inter-diffuse to each other through the porous catalytic bed, and ideally there is no significant non-catalytic cavity filled with an air fuel mixture.

In the present invention, it has surprisingly been found there is a reduced cost and operational advantage to having a cavity within the porous catalyst bed, and that plasma forms within such cavity. The inter-diffusion of fuel and air through the porous catalytic bed achieves a high occupation time over the catalyst for molecules that is equal for all molecules present rather than the situation in forced flow through catalytic beds. In the latter, laminar flow, also known as "streamline flow" or "non-diffusionally driven," mass flow through a random porous catalytic bed leads to non-uniformity of gas composition radially in the flow channels, and an uneven flow distribution such that larger channel flows dominate throughput, and flow rates therein can be high enough to prevent sufficient diffusion to the catalytic sites to catalytically react a portion of the fuel and air. Thus, some of the fuel air mixture can pass by the catalytic surfaces without interacting and produce incomplete combustion. Within the catalytic bed the inter-diffusion catalytic combustion can achieve a temperature gradient from highest on the interior cavity and then drops to the outside, important to achieving complete combustion. The present invention has found that if the outer surfaces of the catalytic bed are kept below 400° C. to 200° C. centigrade with a stoichiometric excess of oxygen to methanol fuel, and a rock wool/catalytic bed is uniformly catalytically active the unburned combustion products can drop below 1 part in 10,000 or the limits of our measuring equipment. By depending on this process of inter-diffusion through a separating catalytic bed wall, the new heater invention does not require fans or pumps. The new invention may use convection air flow and/or jets to admit fuel vapor or air in a distributed fashion, leading to a simple, quiet, clean burning and robust heater system. The hot catalytic surfaces which face the air flow also can fully oxidize and thereby eliminate gases in the air stream such as hydrocarbons and carbon monoxide as they flows through the heater. Additional devices that can be coupled with the heater air inlet are air filters, electrostatic air filters, photo catalytic air filters, absorbers, adsorbers, scrubbers, similar devices or, for the exhaust air, water condensers and/or carbon dioxide traps. Scents and perfume emitters arranged with the heater could be used, and some high molecular weight examples may pass through the heater unoxidized and so may be borne as an additive to the fuel. This heater system can also be used in conjunction with a membrane catalytic heater pending U.S. patent application Ser. No. 10/492,018, incorporated by reference.

SUMMARY

The various exemplary embodiments of the present invention include a catalytic heater comprised of one or more fuel reservoirs, one or more pipes connected to the one or more reservoirs, one or more porous tubes connected to the one or more pipes and directed into a cavity, and the cavity bounded by a porous catalytic wall which is in diffusive contact with an oxidizer gas to achieve catalytic combustion with fuel from the one or more porous tubes. Oxidation may occur on the porous catalytic walls between oxidizer molecules diffusing from outside the porous catalytic walls and a plasma within the cavity diffusing towards the catalytic walls. The plasma is formed from vaporized fuel released via the one or more porous tubes, such that the oxidation generates heat.

BRIEF DESCRIPTION OF THE DRAWINGS

The various exemplary embodiments of the present invention, which will become more apparent as the description proceeds, are described in the following detailed description in conjunction with the accompanying drawings, in which.

DESCRIPTION OF THE REFERENCED NUMERALS

Figure 1:
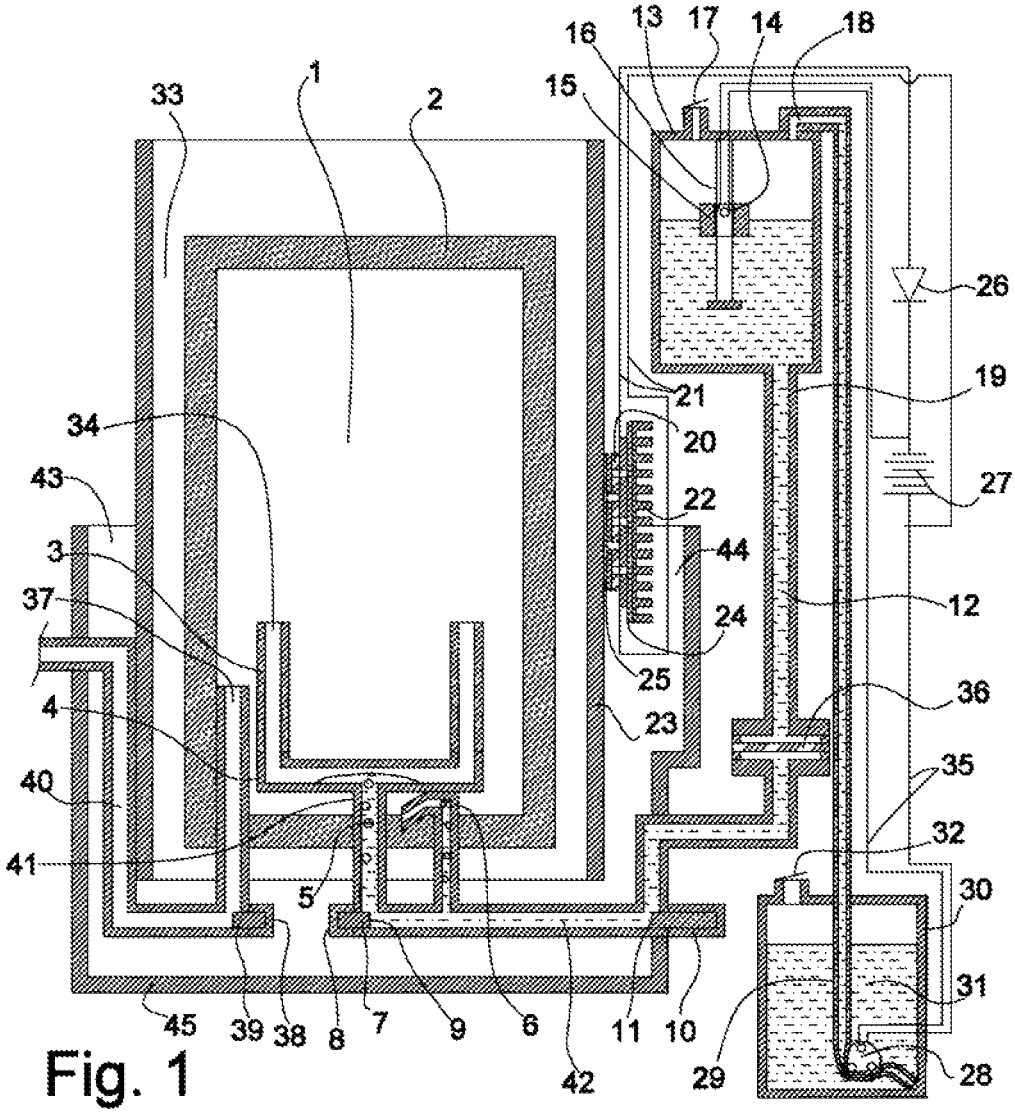
FIG. 1 is an illustration of a cross sectional view of a jet cavity heater and fueling system according to an exemplary embodiment of the present invention.

In reference to the drawings, similar reference characters denote similar elements throughout all the drawings. The following is a list of the reference characters and associated element:

1 catalytic bed cavity
2 catalytic bed
3 porous tube
4 compression fittings
5 boiling fuel
6 one or more small capillary tubes
7 thermal differential expansion actuated relief valve
8 wax actuator
9 valve seal
10 thermal differential expansion actuated thermostat valve
11 wax actuator and valve seat
12 fuel line
13 gravity feed tank
14 fuel level activated switch
15 float
16 rail
17 pressure relief valve vent
18 inlet line
19 outlet line
20 thermopile
21 thermopile electrical outlet
22 heat sink
23 chimney
24 insulating layer
26 electrical diode
27 electrical energy supply
28 peristaltic pump
29 fuel tubing
30 main fuel reservoir
31 fuel
32 fuel inlet and vent cap
33 air flow channels
34 porous tube exit
35 electrical wires
36 fuel filter
37 gas inlet nozzle
38 wax expansion element
39 thermal activated valve
40 gas supply tube
41 small diameter fuel feed tube
43 air inlet
77 battery
87 three-way flow valve
88 first multi flow rate capillary flow limiting tube
89 second multi flow rate capillary flow limiting tube
90 lower heat pipe
91 first side head pipe
92 second side head pipe
94 fan
95 combustion electronic sensor
97 sealed pipe
150 ground level
151 air inlet
152 air vent cover
153 air outlet
154 slab
155 heat pipe
159 heat exchanger wall
169 reservoir of fluid
170 coolant pump
171 fluid flow pipes
203 fluid loops
206 outer stainless steel cage
207 rock wool bed
211 electrical connections
213 wick
214 condensation
216 working fluid
219 conductive layer
218 electrically insulating layer
220 copper or aluminum block
223 loops of tubing
225 small diameter pores
229 heat pipe
230 inner stainless steel cage
251 source reservoir
253 air electrode
254 Nafion membrane
255 fuel electrode
256 fuel delivery membrane
261 stainless steel cage
262 cage contact
264 inner surface of catalytic bed

272 heat pipe reservoir
274 fuel independent heat pipe
275 hydrogen gas
280 flow resistance tube
284 heat exchange reservoir
285 valve
289 fuel manifold
291 heat pipe
300 fuel cell
301 check diode
302 capacitor
303 electrical power controller
304 light emitting diode
305 electrical fan
306 television
307 first switch
308 second switch
309 third switch
340 preheating means

DETAILED DESCRIPTION

FIG. 1 is a cross sectional view of a jet cavity heater and fueling system according to an exemplary embodiment of the present invention. In this exemplary embodiment, the major components include a catalytic burner, a fuel distribution system, a flow control system, and a fuel tank system.

The illustrated catalytic burner has a catalytic bed 2 surrounding a catalytic bed cavity 1, and a chimney 23. The fuel distribution system is comprised of a porous tube 3, compression fittings 4, one or more small capillary tubes 6, and a gas inlet nozzle 37. The flow control system is comprised of a valve seal 9, a wax actuator and valve seat 11, and a fuel filter 36. The fuel tank system is illustrated as being comprised of a fuel line 12, a gravity feed tank 13, an inlet line 18, a peristaltic pump 28, and fuel tubing 29. There may also be one or more electrical wires 35 to the peristaltic pump 28, thermopile 20, and an electrical energy supply 27, preferably in the form of a rechargeable battery.

In an exemplary embodiment, the heater is constructed by forming one or more porous tubes 3 from sintered powder stainless steel. Although the term, "porous tubes" is used herein, the tubes only need to have one exit opening. Thus, for the sake of brevity throughout the detailed description, the term "porous tube" will be used to be interchangeable with "tube having at least one exit opening" in order to allow for easier understanding. In a preferred embodiment, these porous jets have an effective average pore diameter of about 0.5 microns. Other compositions of the one or more porous tubes 3 include, for example, ceramics, arrangements of metal, glass or ceramic capillary tubes, a combination thereof. A woven fiber matrix may also be suitable for the one or more porous tubes.

It is preferred that the one or more porous tubes 3 have about a 0.125 inch inside diameter and an outside diameter of about 0.25 inches. In an exemplary embodiment, the one or more porous tubes 3 are cut to lengths of about 5 cm from an attached fitting connection. Compression fittings 4 are attached to the one or more porous tubes 3. The compression fittings may be comprised of, for example, copper or brass.

In the exemplary example illustrated in FIG. 1, there are two porous tubes 3. The porous tubes 3 and associated plumbing are generally arranged to have fuel enter from the bottom, and the one or more porous tubes be substantially oriented upward where the porous tube exits 34 are located. This exemplary orientation is preferable for holding fuel 31 in the compression fittings 4, small diameter fuel feed tube 41, and the fuel line 12 until the heater starts vaporizing fuel, and therein substantially limits the fuel from simply pouring out through the porous tube exits 34.

The compression fitting 4 in a preferred embodiment have a right angle bend, and then with an about 0.25 inch outer diameter tubing form a substantially T-shape with another porous tube as shown in FIG. 1. The compression fittings 4 and a small diameter fuel feed tube 41 substantially limit flow rate to the one or more porous tubes, and are connected to a thermal differential expansion actuated relief valve 7, a wax actuator, and a valve seal 9. The thermal differential expansion actuated relief valve is preferably mounted on a perimeter frame of the catalytic heater. Such mounting provides sufficient heat transfer from the catalytic heater to the thermal differential expansion actuated relief valve to allow the thermal differential expansion actuated relief valve to open from the heating of the catalytic bed 2 and use the heat transfer into boiling fuel 5 to keep the thermal differential expansion actuated relief valve open. It is preferred that the thermal differential expansion actuated relief valve is a thermal expansion valve that opens at about 63° C. and closes at about 46° C. with a wax actuator 8 that moves off the valve seat 9.

A starting heater fuel delivery system may be formed with an about 0.010 inch inside diameter 0.0625 outside diameter and the one or more small capillary tubes 6 that are placed against an inside bottom surface of the catalytic bed 2. Such capillary steel tubes may be formed from stainless steel. Catalytic beds can be comprised of platinum and other catalytic materials dispersed over ceramic fiber or rock wool bed. Several alumina spheres, coated with 1% platinum by weight, may be dispersed throughout the catalytic bed to achieve hot spot starting. The one or more small capillary tubes 6 are connected to the fuel line 12. The one or more small capillary tube 6 can have limited flow rates determined by laminar flow drag through one or more small capillary tubes, and by the pressure of the fuel 31 into the one or more small capillary tubes 6. The flow resistance through the one or more small capillary tubes 6, small diameter fuel feed tube 41, fuel line 12, and outlet line 19 can also create an upper power limit on the heater system depending on the pressure from the gravity feed tank 13. If the temperature in the one or more small capillary tubes 6 and/or the small diameter fuel feed tube 41 exceeds the boiling point of the fuel 31, and the fuel boils, the fueling rate dramatically drops to roughly about five percent of the fuel delivery rate due to the boiling fuel 5 having a considerably higher volume and flow velocity and therein changing the drag effect through the one or more capillary tubes.

A mathematical relationship of the delivered laminar fuel (fluid) flow rate to the to a pressure of a fuel across a particular tube (P), a radius of the particular tube (r), a length of the particular tube (l), a viscosity of the particular fuel (μ), and the density of the fluid (ρ) is the following:

$$\text{Fuel delivery rate}=\rho*\pi*P*r^4/(8*\mu*l)$$

This laminar flow resistance mechanism can be used as a self temperature limiting effect on the heater such that when the fuel boils in the one or more small capillary tubes 6 and the small diameter fuel feed tube 41, the fuel flow rate will drop by a factor of roughly 20 and the heater will self limit. This effect is due to the volume of the liquid fuel changing from about 0.79 gm/ml to about 0.00114 gm/ml at about 65° C. at sea level air pressure. This results in a volume change of 693 times lower. The viscosity of the fuel changes from μ(liquid) of about 0.00403 Poise of the liquid to μ(gas) of about 0.000135 Poise of methanol gas at 65° C. Thus, the fuel delivery rate is estimated to drop by a factor of 1/23.2 times for gas flow divided by the fuel delivery rate of liquid fuel. Fuel delivery ratio=Gas fuel delivery/Liquid fuel delivery=ρ(gas)*μliquid)/(ρ(liquid)*μ(gas))=0.04308=1/23.2.

In the one or more porous tubes 3 the fuel 31 can flow through small wall pores of the one or more porous tubes with a flow rate that can be mathematically modeled by multiplying the number of equivalent small pores by the fuel delivery rate and the pressure head created by the height of the fuel in the one or more porous tubes. When the fuel is fully or substantially vaporized, the fuel flow through the small pores is dramatically reduced and the flow is dominated by the flow through the porous tube exit 34.

Essentially the flow through the one or more porous tubes is then dominated by a jet flow out of the porous tube exit 34 while some flow and diffusion of fuel comes out through small wall pores of the one or more porous tubes 3. Such jet flow may be throttled or adjustable as needed. The flow of fuel through the small wall pores can be catalytically or plasma combusted or reformed on the side of the one or more porous tubes 3, therein keeping the one or more porous tubes heated to transfer heat into the fuel to maintain the fuel boiling and vapor flow by supplying the heat of vaporization of the fuel 31. Although the porous tube exit is illustrated in the figures as being open, the porous tube may be substantially covered or capped such that the flow of fuel must escape through the small wall pores and not through the porous tube exit. In addition, although the porous tubes are illustrated as being in a substantially vertical direction, the porous tubes may be positioned as being substantially horizontal relative to a base of the heater or any position between the substantially vertical and substantially horizontal position. As a result, the sides of the one or more porous tubes may be covered in a plasma when air (oxygen) is at stoichiometric excess, or hot plasma, and may also maintain the flame/plasma as the vaporized fuel flows out of the porous tube exit. A dynamic equilibrium can be achieved on the one or more porous tubes 3 between small walls pore flow through the sides of the one or more porous tubes combusting and transferring the heat to provide the heat to vaporize and possibly reform the fuel in the porous tube exit fuel flow.

The rate of fuel flow and diffusion through the sides of the one or more porous tubes 3 should automatically adjust to keep the fuel flow through the one or more porous tubes 3 as a vaporized fuel. If fuel is not vaporized in the one or more porous tubes, the liquid fuel on an inner surface of the one or more porous tubes 3 will flow and diffuse through the sides of the one or more porous tubes 3 and increase the heating of the one or more porous tubes until the porous tube exit is vaporizing more of the fuel 31, and vice versa. If the fuel is substantially vaporized when the fuel reaches the one or more porous tubes 3, the fuel flow rate through the sides of the one or more porous tubes will be reduced and the heating and vaporization of the fuel until liquid fuel contact returns to a base of the one or more porous tubes 3.

A similar dynamic equilibrium system can be achieved with the one or more porous tubes 3 surrounding a vertical wicking arrangement of fuel being wicked into a combustion area at the porous tube exit 34 and the some of the heat of combustion from a surface of the one or more porous tubes are transferred into the boiling of the fuel. If the fuel is fully vaporized within such wick, less fuel is delivered through the sides of the one or more porous tubes and the delivery of fuel is throttled back. If more liquid fuel is wicked, the heating of the one or more porous tubes is increased and the vaporization of the fuel is increased. The preheating means may be, for example, a catalytic or electric heater.

Figure 7:
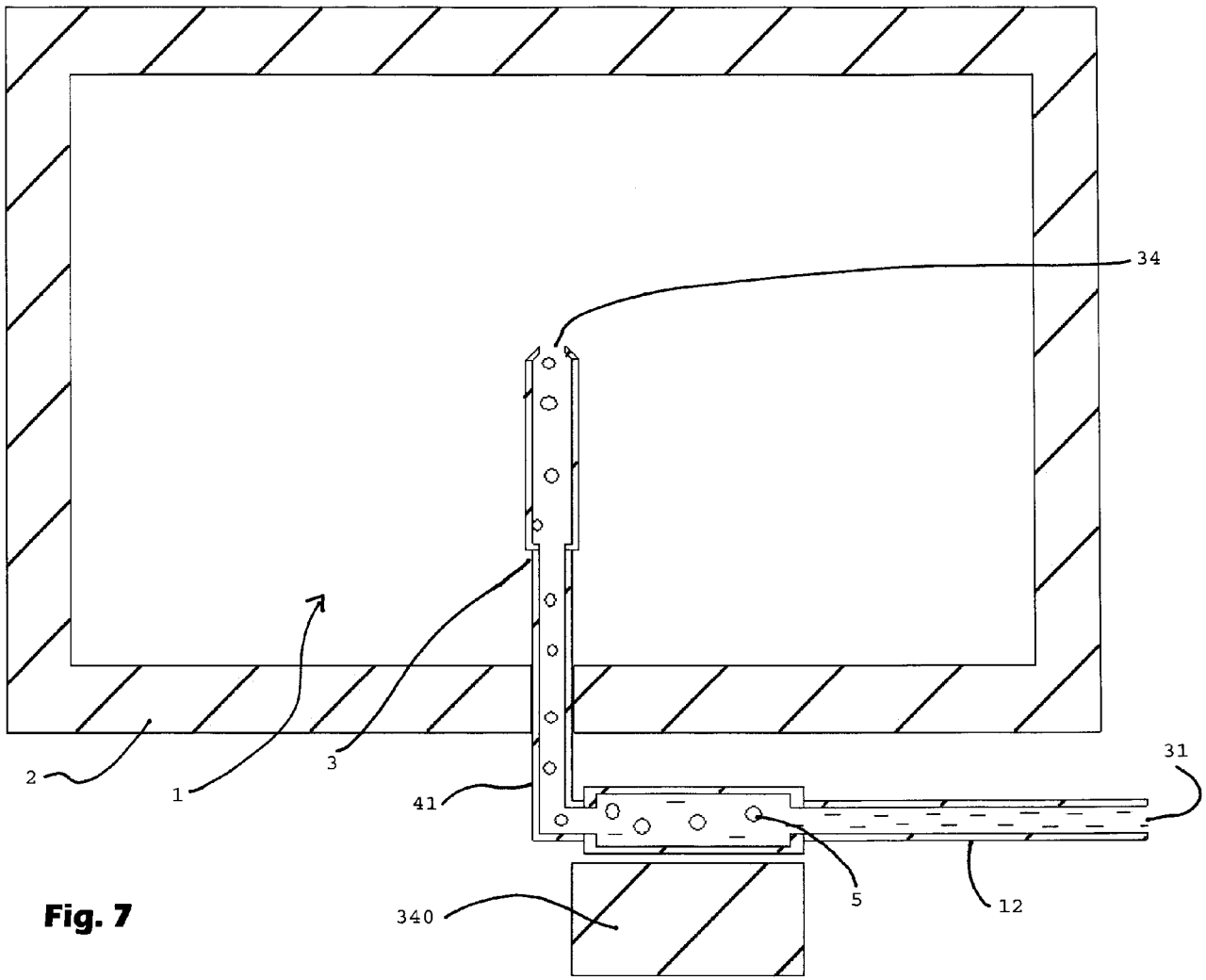
FIG. 7 is an illustration of a close-up cross sectional view of a jet cavity heater and fueling system having a preheating means according to an exemplary embodiment of the present invention.

For very high flow rates through the one or more porous tubes 3, heat transfer back to the liquid fuel to vaporize the liquid fuel is needed to maintain the vaporization of the fuel. In exemplary embodiments herein, preheating through the sides of the one or more porous tubes 3 is dependent upon liquid or vapor in a closed thermal loop to achieve maximum responsiveness and thereby create a responsive and dynamic self fuel vaporizing preheating system. FIG. 7 illustrates a preheating means 340 positioned adjacent to fuel line 12. Such preheating allows an initial amount of fuel to be heated without a steady flow of fuel, thereby allowing for more efficient warming of the heater and with less loss of fuel.

The preheating means is that through which the liquid fuel passes and in which it is boiled. Examples of the preheating means include a simple metal tube to a sophisticated radiator like design. The specifics of how it is designed will be based upon factors such as the watt output of the desired preheating means, the rate at which the fuel travels through the heat exchanger, the efficiency at which the specific design can transfer that heat to the fuel, the temperature of the fuel, the boiling point of the fuel, etc. The preheating means could also be in close proximity to, or potentially even attached to, a primary heater cage which could allow the main heater to "take over" the fuel preheating once the main heater is up to a desired or predetermined temperature.

The preheating means is preferably limited in its heat output. This can be accomplished via fuel restrictions to the preheating means or via some means of thermostatically controller, such as, for example, with a valve similar to the thermal valve or via some electrical means, for example, from a simple bimetal thermostat to a computer (micro-controller) with temperature inputs which operates a valve, or even through a tube to fuel the preheating means which goes through or near the preheating means just as the heat exchanger does which causes the fuel flow to dramatically decrease due to back pressure in the line when the preheating means fuel boils.

In the catalytic bed cavity 1, the fuel may combust with air at high temperatures and then diffuse into the adjacent catalytic bed 2 to substantially complete combustion at lower temperatures in the catalytic bed 2 as the fuel diffusion in the catalytic bed cavity 1 meets the diffusion of oxygen from the air in the chimney 23.

The lower temperature catalytic combustion is more complete and favors the products of carbon dioxide and water versus carbon monoxide and hydrogen which can be produced in high temperature combustion. The temperature gradient created from the heat transfer from highest on the inside of the catalytic bed cavity 1 to an outside surface of the catalytic bed 2 produces the desired temperature gradient for complete combustion of the fuel and air. Measurements of embodiments of the present the catalytic heater produced combustion efficiencies of better than 99.984% efficiency in combusting methanol, as the fuel, with air.

It should be mentioned that this type of combustion can be used to safely combust a variety of fuels. An example is that of non-combustible mixtures of gas such as tail gasses from refineries. Such fuels can be substituted for the liquid fuel and/or mixed with or in a parallel fueling arrangement feeding the catalytic bed cavity. Methanol, dimethylether, or liquid fueled porous jets, for example, can be feeding fuel adjacent to gas inlet nozzle 37 that delivers fuel as a pre-heated gas stream once the temperatures are high enough to open the wax expansion element 38 and thermal activated valve 39.

Catalytically combustible gases such as, for example, hydrogen, carbon monoxide, methane, propane, pentane, ether, ethane, butane, ethanol, propanol, and other hydrocarbon compounds may also be used. An example of a gas that can be fed in a refinery tail gas is a gas that is comprised of some hydrogen and methane and carbon monoxide but is diluted with sufficient nitrogen and non-combustible gasses such that the gas alone cannot sustain a flame.

The pre-heated gas stream in the gas supply tube 40 may be heated from heat transfer from the chimney 23, the catalytic bed 2, and the exhaust air flow channels 33 into the gas supply tube 40 and the catalytic bed 2, thereby catalytically oxidizes lean mixtures of fuel in the catalytic bed 2 with oxygen diffusing through the catalytic bed 2. A particular advantage of having the fuel pre-heated in the gas supply tube, separate from the air flow channels 33 and air inlet 43, substantially avoids having a large volume of mixed fuel air of as in a conventional burner, which can lead to explosions injuring individuals and property.

In an exemplary embodiment, the air can also be pre-heated through the heat exchange with heat transferred from the chimney 23 into the air inlet 43. By pre-heating the fuel and air, the heater is more efficient. Further, for low combustibility mixtures in the gas supply tube 40, it may be necessary to maintain combustion because the energy in the fuel air mixture is insufficient to heat the gas to the combustion temperature and/or catalytic combustion temperatures.

In the exemplary embodiment using tail gas, the combustibility of the mixture can vary in time as the chemical concentrations and temperatures change. Such variances can lead to unstable combustion and explosions. The thermostatic aspects of exemplary embodiments of the present heater substantially maintain operational conditions in the heater; essentially compensating for the varying combustibility of tail gasses. A catalytic oxidation termination on the cooler outer surface of the catalytic bed 2 with a comparably oxygen-rich environment in the air flow channels 33 substantially ensures that the catalytic oxidation favors full oxidation of the carbon monoxide and hydrogen in the gasses.

Exhaust of from the catalytic heater diffuses out into the convective or forced air flow past the catalytic bed 2. The catalytic bed 2 radiates to the surrounding chimney 23. Conduction, convection, and radiant heat transfer will occur from the catalytic bed 2. Additional heat transfer could occur by conduction contact to the catalytic bed 2 or conduction from the chimney 23. Heat pipes and circulated fluid conductors can be placed on of the catalytic bed 2 or chimney 23. For example, one or more thermopiles 20 are placed in thermal contact on the chimney 23 or in radiant thermal contact with the catalytic bed 2. The thermopile is preferably electrically insulated through an insulating layer while still making thermal contact. Such insulating layers are preferably comprised of alumina. The heat sink 22, also known as a cold junction, of the thermopile can be arranged to pre-heat air in the air inlet 43. The heat sink 22 is also cooled by convecting air into surrounding air. The low temperature heat sinking 22 of the heater can be incorporated into structures such as floor mats, walls, beds, automobiles, machinery, electronics, and apparel drying racks.

Fuel delivery to the small diameter fuel feed tubes 41 and the one or more porous tubes 3 is from a gravity feed tank 13 and main fuel reservoir 30. The main fuel reservoir 30 may have a fuel inlet and vent cap 32. Fuel is directed from the main fuel reservoir 30 to the gravity feed tank via the pump 28, the fuel tubing 29, and the inlet line 18. The gravity feed tank may include a pressure relief valve vent 17. From the gravity fuel tank, the fuel goes though a piping system and series of flow control components including an outlet line 19, the fuel filter 36, the thermal differential expansion actuated thermostat valve 10, the wax actuator and fuel seat 11, the thermal differential expansion actuated relief valve 7, the wax actuator 8, and the valve seat 9.

The main fuel reservoir 30 may be a fuel tank such as, for example, a 50 gallon tank that can be located outside the building to be heated. Such tank can be buried, covered, and the like for aesthetic desires. The fuel inlet and vent cap 32 substantially prevents excessive negative or positive pressure buildup within the main fuel reservoir.

The pump 28 may be in the form of, for example, a peristaltic pump or a piezoelectric pump diaphragm pump. Electrical power is delivered to the pump through electrical wires 35.

The gravity feed tank 13 of exemplary embodiments may be of approximately 300 ml fuel volume to provide a steady gravity pressure head feed to the heater. Although described herein as a gravity feed tank, fuel may flow through the present system by pressure and/or pump action. Within the gravity feed tank 13 there may be a fuel level activated switch 14 located on a float 15 and rail 16. This fuel level activated switch turns on the fuel pump 28 in the main fuel reservoir 31 when the fuel level is determined to be low, and turns off when the fuel level is determined to be at the desired level or too high. The gravity feed tank 13 has a pressure relief valve vent 17 to substantially regulate the pressure inside the gravity feed tank and avoid positive or negative pressure build up and thereby allow this tank to deliver a precise gravity head pressure to the heater. The pressure relief valve vent 17 could be incorporated in an access cap to the gravity feed tank 13.

In a starting mode of operation the heater system can be started by filling the gravity feed tank 13 with fuel. This could fuel the heater and be able to generate sufficient electricity delivered to the thermopile electrical outlet 21 through an electrical diode 26 from the thermopile 20 to run the pump 28 in the main fuel reservoir 30 or charge the electrical energy supply 27 in the form of one or more batteries which may then run the pump 28 in the main fuel reservoir 30.

The fuel filter 36 may be, for example, a porous stainless steel frit with average 10 micron pores positioned in the outlet line 19 with a stainless steel holder.

The thermal differential expansion actuated thermostat valve 10 and wax actuator and valve seat 11 open to allow fuel to flow below a predetermined temperature, and then and close to stop or slow fuel to flow above a predetermined temperature. N a variation, only one of the thermal differential expansion actuated thermostat valve 10 and wax actuator and valve seat 11 open, thereby stopping or slowing the flow of fuel. The predetermined temperature can be set with a screw dial adjustment to the wax actuator and valve seat 11 force against the thermal differential expansion actuated thermostat valve 10. Other types of thermostat valves such as electrically actuated valves or electrically driven pumps could also be used for the thermal differential expansion actuated thermostat valve.

The heater system may also include sensors such as carbon monoxide or oxygen content sensors, fans, and lights, and the like.

In operation, a side of the thermopile 22 adjacent to the chimney 23 is heated wherein the heat is then transferred to the other side of the thermopile 22 and into the heat sink 22 which is cooled by air flowing in the air inlet. Electrical current generated by the thermopile goes through the thermopile electrical outlet 21, through an electrical diode 26 to charge a battery, the electrical energy supply 27. The electrical diode 26 is necessary to ensure one-way electrical current charging of the battery and not allow the battery to be discharged back through the thermopile 20 when the heater is off. It should be noted that a super capacitor could be used to store the electrical energy rather than a battery. The battery may be in the form of, for example, a nickel metal hydride battery, a lead acid battery, a lithium polymer battery, or a lithium ion battery. The stored electrical energy in the battery will flow when the fuel level activated switch 14 closes when the fuel level is low. The electrical current flows through the pump 28 and more fuel 31 is pumped into the gravity feed tank 13. When the fuel in the gravity feed tank reaches a predetermined level, the fuel level activated switch opens and the electrical current to the pump 28 is stopped. It may be useful in some situations to have a check valve in the inlet line 18 such that when the pump 28 stops pumping it does not siphon back through the fuel line 29 into the main fuel reservoir 30.

Fuel may also be pumped using a manual and/or automatic pump in order to advance an initial amount of fuel to be preheated such that the heater may more efficiently reach a desired temperature without a steady flow of fuel.

Figure 2:
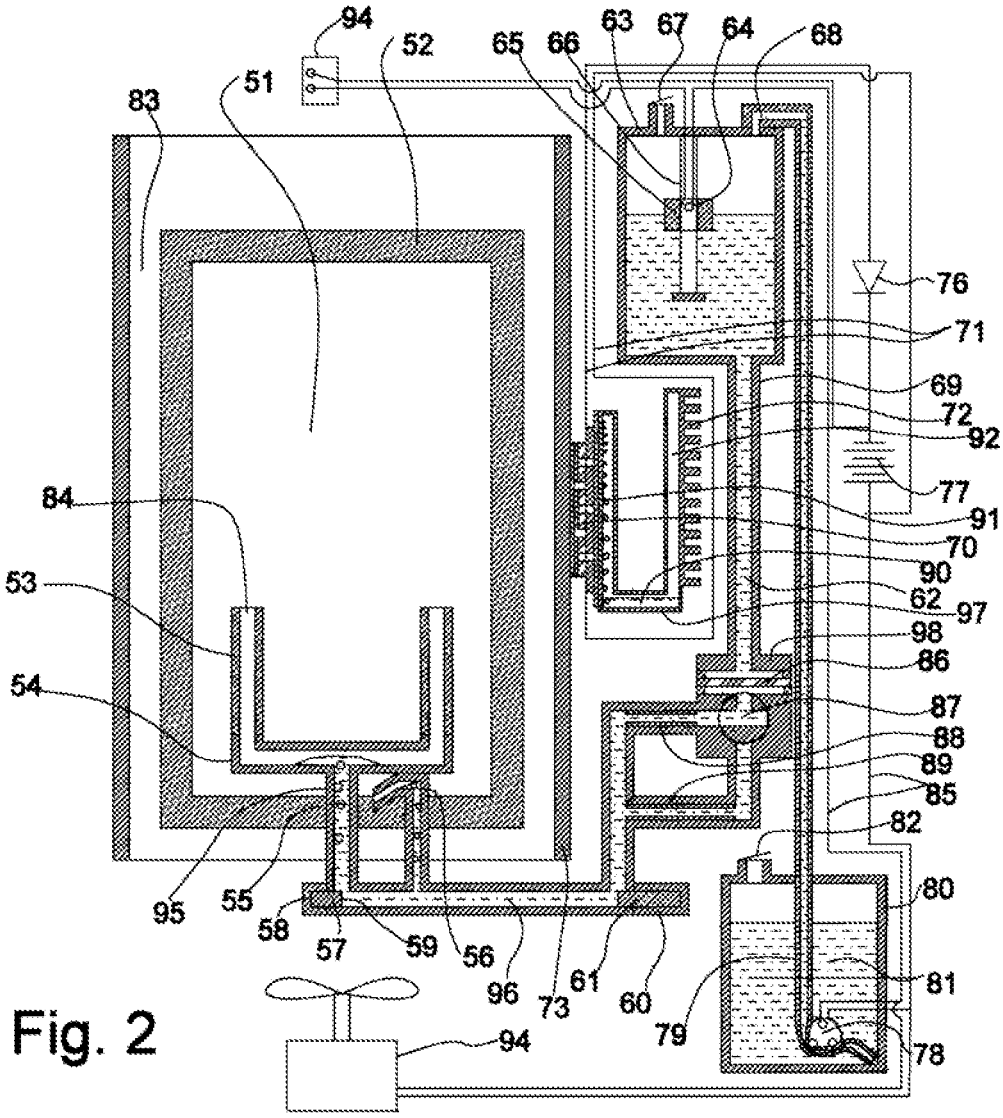
FIG. 2 is an illustration of a cross sectional view of a jet cavity heater having a flow control valve, capillary tube network, heat pipe, gas products sensor, and fan according to an exemplary embodiment of the present invention.

In FIG. 2 the heater system is shown with additional embodiments of a first and second multi flow rate capillary flow limiting tubes 88 and 89, respectively, having a three-way flow valve 87, a lower heat pipe 90, a first and second side head pipe 91 and 92, respectively, on the electrical insulation layer between the theromopile and chimney 23, a fan 94, air flow and a combustion electronic sensor 95.

In this exemplary embodiment, the flow control through the valve and capillary tubes allows the power output of the heater to be set by different flow rates through the first and second multi flow rate capillary flow limiting tubes 88 and 89. The first and second multi flow rate capillary tubes can also be placed as a safety feature with a thermal contact to the catalytic heater such that if the heater is excessively hot, such as, for example, when air flow is blocked in the chimney, the fuel in the first and second multi flow rate capillary tubes will boil and limit the fuel delivery to the heater. In such exemplary embodiment, electrical insulation layer between the theromopile and chimney 70 is used in conjunction with the with a lower heat pipe 90, a first and second side head pipe 91 and 92, and the heat sink 22, which may be in the form of a finned heat sink. The output of the thermopile is used to run the air flow fan 94, pumps 28, and charge batteries 77. The first and second multi flow rate capillary flow limiting tubes may be positioned on a surface of the chimney 23, or on the surface of the heat sink 22.

In the exemplary embodiment illustrated in FIG. 2, the more porous tubes 3 are comprised of sintered powder stainless steel having an effective average pore diameter of 0.5 microns. The porous tubes preferably have a 0.125 inch inside diameter and an outside diameter of 0.25 inches, and are cut to lengths of five cm from the compression fittings 4, preferably comprised of brass. The compression fitting preferably have a right angle bend and then 0.25 inch outer diameter tubing to form a T-shape with another porous tube as shown in FIG. 2. The small diameter fuel feed tube 41 may be brazed as ¼ inch diameter copper tube from ⅛ inch diameter tubing. The small diameter fuel feed tube capillary tubes limit the flow rate to the jets and are connected to a valve seal 9 that is mounted on the perimeter frame of the catalytic bed 2 or chimney 23 of the catalytic heater. Such mounting to the catalytic bed 2 or chimney 23 and thermal conductivity of the porous tubes and small diameter fuel feed line provides sufficient heat transfer from the heater to the thermal differential expansion actuated relief valve 7 to allow such valve to open from the heating of the catalytic bed and use the heat transfer into the boiling fuel to keep the thermal differential expansion actuated relief valve open.

Exhaust of from the catalytic heater diffuses out into the convective or forced air flow past the catalytic bed 2. The catalytic bed 2 radiates to the surrounding chimney 23. Conduction, convection, and radiant heat transfer will occur from the catalytic bed 2. Additional heat transfer could occur by conduction contact to the catalytic bed 2 or conduction from the chimney 23. In an example embodiment, heat is transferred to the wall of the chimney 23 and heat travels through the thermopile. The thermopile is then heat sinked through the lower heat pipe 90 and the first and second side head pipe 91 and 92 which dissipate heat through a heat sink 22 to the surrounding air or surfaces such a floor mat, apparel, furniture, ducts, machinery, automobiles, mirrors, windows, electronics, or building walls.

The lower heat pipe 90 and the first and second side head pipe 91 and 92 may include of a working fluid in a sealed pipe 97, which may be in the form of a flexible walled heat pipe, with a wicking material on an inside of the sealed pipe 97. Gravity flow back is used to return condensed working fluid back to the wicking material. If an impurity is added to the heat pipe working fluid or pressurization of the sealed pipe 97 is used, the boiling point of the working fluid could be set and the sealed pipe could remove heat and deliver heat at a set temperature.

The three-way flow valve 87 is positioned after the fuel filter 36 in the embodiment illustrated in FIG. 2. Typical positions of the three-way valve valve 87 are: off, and two flow routes to the different flow rate capillary tubes.

The electrical system for exemplary embodiments of the present invention may include a thermopile generator, diode, one or more batteries, a fuel level switch, fuel pump, air flow fan, and a combustion sensor in the exhaust air stream. The combustion sensor may detect such gases as, for example, carbon monoxide, unburned fuel, heat, or oxygen content. If oxygen content of the system goes too low, or if carbon monoxide or unburned fuel is too high, the combustion sensor can shut off power to the fuel pump and shut down the heater system. Other possible arrangements are to shut off the fuel valve and sound an alert, a light or visual display of the fault condition to the user. The combustion sensor could also detect heat and regulate power of the heater by controlling the fuel delivery valve to regulate the temperature or heat delivery to the room, apparel, machinery. The air flow fan moves air past the heater system to increase air flow through the chimney 23 and increase oxygen delivery to the catalytic bed and therein increase the heat transfer to the surroundings.

The heater could be started by pouring fuel into the gravity feed tank 13 through the port capped with a vent. The fuel is gravity fed through the filter, then the through the three-way flow valve 87 and one the first and second multi flow rate capillary flow limiting tubes 88 and 89. The fuel flows into the one or more small capillary tubes 6. The fuel, wicks into the catalytic bed where it is vaporized, diffuses, and catalytically combusts in the catalytic bed with the in-diffusion of oxygen from the outside air. Heat from the catalytic combustion increases the temperature of the porous tubes, the seal pipe, one or more small capillary tubes, the porous tubes, and the thermal differential expansion actuated relief valve. When the temperature reaches a temperature that opens the thermal differential expansion actuated relief valve, such valve opens and a larger flow rate of fuel goes to the porous tubes. Some of the fuel vaporizes in the porous tubes and a portion of the fuel diffuses through the sides of the porous tubes. Increased catalytic combustion occurs in the catalytic bed as more diffusion of fuel meets oxygen diffusion in the catalytic bed until the heater self temperature regulates through the thermal differential expansion actuated thermostat valve. When steady state operation of the heater is achieved, the temperature is highest in an interior of the catalytic bed and cooler on an outside of the catalytic bead due to removal of heat from the outside by radiation, conduction, and convection. By being coolest on the exterior, the catalytic bed lowest equilibrium temperature favors complete combustion, thereby minimizing carbon monoxide formation on the exterior of the catalytic bed.

Plasma can also form within the catalytic bed cavity of the catalytic bed. This plasma can also heat the porous tubes and connected fuel lines to keep the fuel vaporized in a dynamic equilibrium to maintain a steady jet of vaporized fuel to the catalytic bed cavity within the catalytic bed. Such dynamic equilibrium is a balance of the heating the porous tubes to vaporize the fuel, and to supply fuel through the sides of the porous tubes to heat the sides of the porous tubes. When the porous tubes are hot fuel is vaporized and less fuel is delivered through the sides of the porous tubes reducing the heating of the porous tubes. When the porous tubes are cool, more fuel is delivered through the sides of the porous tubes and the fuel delivery through the sides of the porous tubes is increased.

In operation the heater creates a high temperature difference across the thermopile to produce electrical current to charge the battery, run the fuel pump in the main fuel reserve, run the sensor system and run the air flow fan. A heat pipe system including, for example, the lower heat pipe 90 and the first and second side head pipe 91 and 92 can be extended away from the heater to do tasks such as heat machinery, fuel cells, beds, apparel, floors, walls of buildings.

Figure 3:
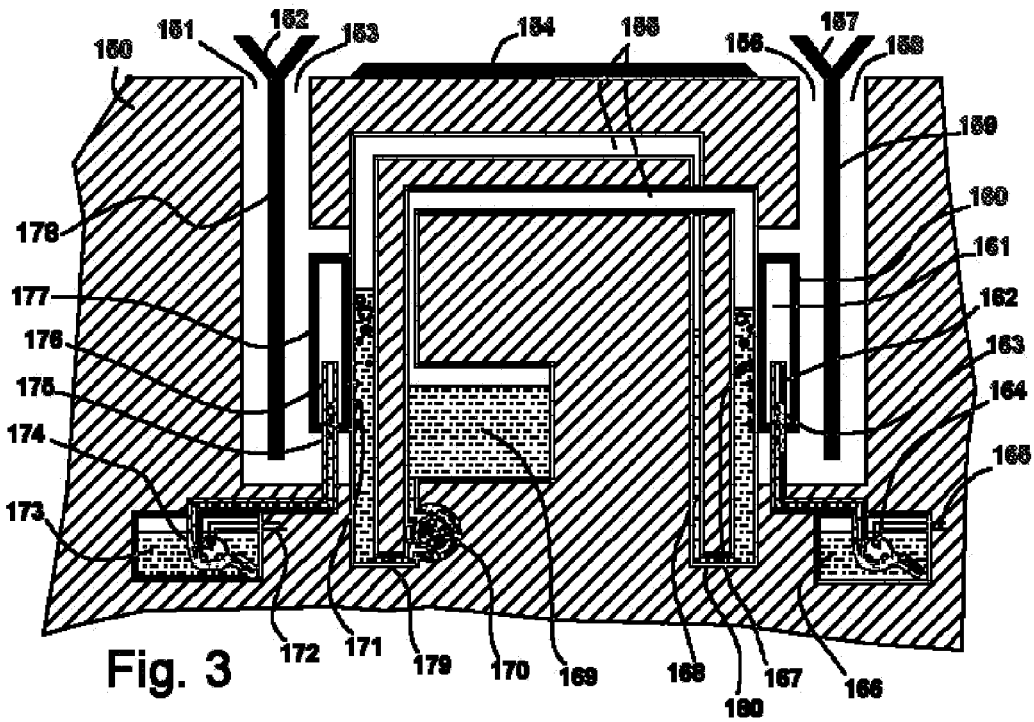
FIG. 3 is an illustration of a cross sectional view of the heater system according to an exemplary embodiment of the present invention, wherein the heater system is applied a heat pipe or fluid flow system.

FIG. 3 illustrates an exemplary embodiment having the catalytic bed thermally connected to a heat pipe or fluid flow system. In this particular embodiment, the heaters bellow the height of the intended condensation area or heat delivery area, thereby allowing convection and condensation to cycle the fluids and the air flow through the catalytic heaters and pipes.

In FIG. 3 the ground level 150 is shown and the air inlet 151 come up out of the ground. An air vent cover or roof 152 is used to prevent rain, snow, dirt, and the like from falling down into the heater system. The air vent cover may also act as a diverter to prevent the outlet exhaust air from mixing with the inlet air stream.

Air enters the air vent 151 and flows down into the heater system. As the air flows, it is heated through the heat exchanger wall 159 separating the air inlet and air outlet 153. This heat exchange from the exhaust air into the inlet air allows the heater to be more efficient by recovering heat from the exhaust. However, condensation of water in the exhaust air can occur which is important in runway heating applications to reduce the condensation plume and avoid obscuration of the runway. Condensed water on the heat exchanger wall can be collected and removed from the system. When the air reaches the catalytic heater bed, it diffuses into the catalytic bed and catalytic bed cavity. Plasma combustion can occur inside the catalytic bed cavity and then catalytic combustion can occur in the catalytic bed at a relatively lower temperature. The exterior of the catalytic bed is in conduction, radiation, and convective thermal contact with the air inlet and the heat pipes or fluid flow pipes 171. This insures that there is a temperature gradient from the inside to the outside of the catalytic bed. Such gradient of temperature in the catalytic bed, diffusion of reactants, and excess oxygen supply on the exterior surface of the catalytic bed assures that the heater achieves substantially complete combustion.

If the heater is operated with excessive fuel or likewise insufficient air flow, the heater will produce non-combusted fuel in the exhaust and can be detected with a catalytic sensor in the exhaust ash shown in FIG. 2 the fuel pumps can then be throttled or shut down. Through conduction, convection, and radiant heat transfer with the fluid flow tubes, the fluid boils or is flowed by the heater. When boiling of the fluid is not occurring, a pump 28 can be used to circulate the fluid. A reservoir of fluid 169 is used to allow the system to hold all the fluid in the pipes of the system allowing for the fluid circulation to be stopped. Thus the reservoir of fluid 169 and pump 28 can act as an on-off mechanism for the heat pipe 155. The reservoir of fluid 169 may also be used to simply be able to allow the pipes to be empty to repair the pipes.

It is anticipated that in working situations wherein the pipes are embedded in a runway, road way, or concrete slab of a building, leaks could occur. The heat pipe operation would be hampered by leaks by allowing air into the pipes, but the system could still be operated by circulating liquid or a mixture of liquid and gas vapor using the coolant pump 170. The reservoir of fluid 169 could be sized sufficiently to permit a modest leakage rate and serviceable refilling of the fluid circulation system. The working fluid in the piping desirably is an inert low cost fluid with a high thermal capacity, does not freeze, and boils at the temperature that the heater needs to deliver sufficient heat to the surface of the runway, landing pad, roadway, walk way, athletic fields, greenhouse, building floor, ship deck, automobile, machinery, or structure. Examples of such fluids include, for example, as chlorofluorocarbon fluids, ammonia, water, methanol, ethanol, carbon dioxide.

Particular applications such as a concrete slab 154 may need temperatures above the thermal reservoir of the ground so the heater is turned on and increases the working fluid temperatures above the heater to achieve higher heat flow rates into the slab 154. The thermal reservoir could be the ground 150, a body of working fluid, or a body of water, which is heated by a heat source of solar energy, geothermal energy, or waste heat from heat pipe systems, or waste heat off a thermal power plant. The thermal reservoir of fluid 169 could be in thermal contact with the heat source through circulated fluid filled pipes from the heat source and used to store thermal energy in the working fluid reservoir of fluid 169 and ground 150.

Figure 4:
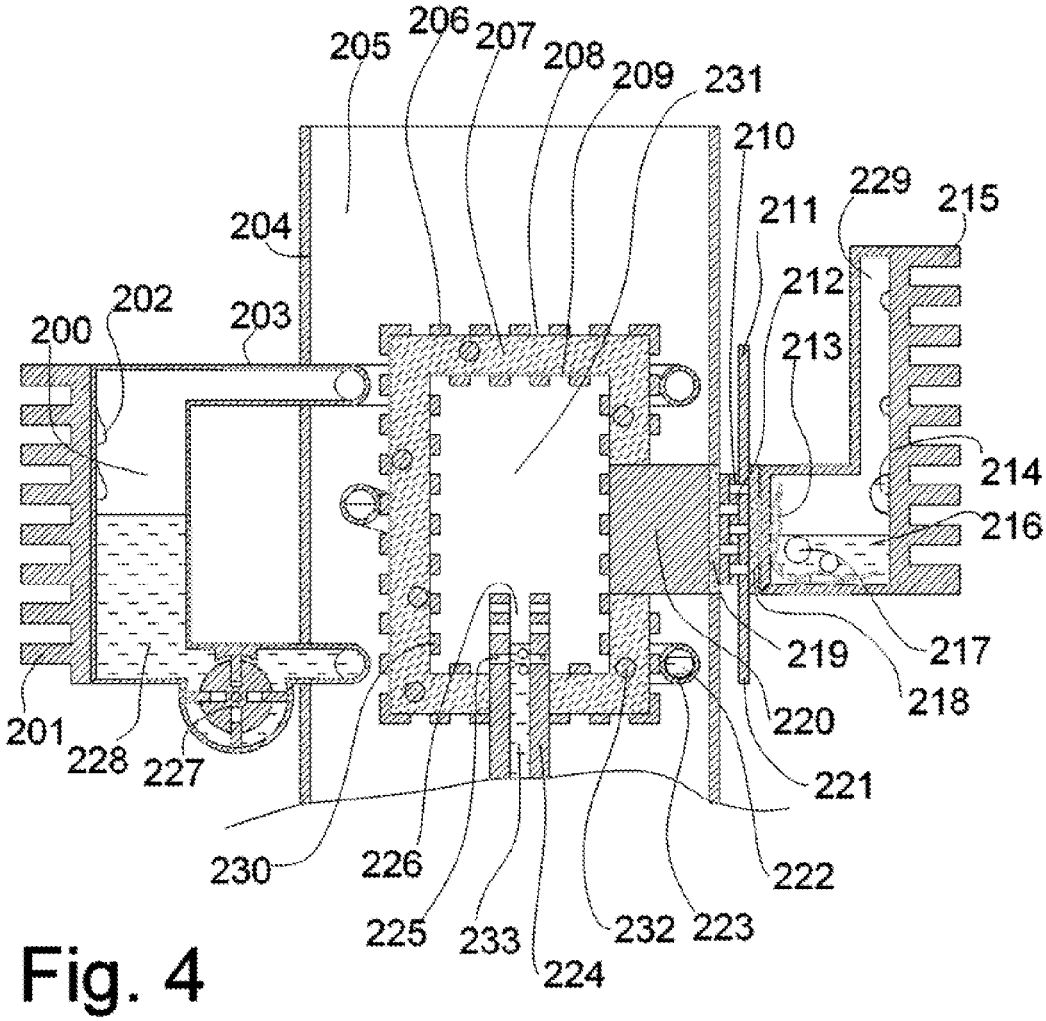
FIG. 4 is an illustration of a cross sectional view of catalytic reaction gradients in a catalytic bed according to an exemplary embodiment of the present invention.

In FIG. 4 an exemplary embodiment of the heater system is shown coupled to a heat pipe and a fluid flow heat transfer system. The heater system is constructed with the porous tubes substantially surrounded by the catalytic bed cavity of the catalytic bed 2. The catalytic bed may be used as preheating means for heating an initial amount of fuel without a steady flow of fuel. The catalytic bed cavity preferably has an inner stainless steel cage 230 and an outer stainless steel cage 206 that is comprised of porous catalytically coated rock wool bed 207 and catalyst coated alumina spheres 232 embedded in the porous catalytically coated rock wool bed 207. The term "cage" as used throughout is meant to convey a surrounding means that has at least some portion that is open, perforated, vented, or the like. The porous tubes have small diameter pores 225 on the side of the jet nozzle the allow a low rate of fuel delivery through the sides of the tube to maintain heating of the nozzle to maintain the boiling of the liquid fuel and jet flow out the end of the porous tube exit. The moderated heating rate of the fuel to achieve a steady jet flow rate is maintained by the dynamic equilibrium between liquid and gaseous fueling rate differences through the small diameter pores 225 of the porous tube exit.

The air flow in this embodiment is flowing past the catalytic heater bed in the chimney surrounding the catalytic bed. The heat from the catalytic bed 2 can be transferred to air or fluids outside of the heater and chimney through one or more heat pipes or a fluid pumped or valve circulated system. The pumped or valved fluid circulation system could circulate a liquid, boiling liquids, and gasses. A passive heat pipe system shown makes thermal contact through a copper or aluminum block 220 to the inner stainless steal cage 230 and by radiant heat transfer from the catalytic bed cavity 1 inside the catalytic bed. In such arrangement, the thermal contact is with catalytic bed cavity to achieve the highest possible temperature difference across the thermopile. Due to properties of the diffusion nature of this catalytic bed, the oxygen diffusing in on the surface of the catalytic bed is heated while oxygen diffusing out as exhaust products from the inside of the catalytic bed are cooling, the higher temperatures of the heater will be where the inter-diffusion of reactants meet to achieve combustion and or catalytic combustion. By thermostatically controlling the fuel delivery a maximum temperature zone in the catalytic bed and plasma in the catalytic bed cavity can be arranged to be near where the stainless steel cage can collect the heat and deliver it to the copper block 220 and thermopile for maximum efficiency.

In steady state operation, the combustion zone can be stationary within the catalytic bed and the heat losses by conduction and radiation through the catalytic bed can be kept small compared to the heat delivered through the stainless steel cage 230. This is in contrast to a flowing combustion system where heat is removed by the hot gas flowing over a metal surfaces and subsequent lower temperature heat removed further along the flow. In the flowing combustion system, efficient heat delivery is achieved by pre-heating the air with a heat exchanger between the exhaust and incoming air. Thus, the catalytic heater has the capability of efficiently delivering high grade heat through the stainless steel cage without using heat exchangers for the inlet and outlet air flows and pumps. This can be particularly useful in situations, as earlier mentioned, in catalytically combusting low energy value fuels, small sizes, or non-flammable fuel-gas mixtures such as tail gas from refineries. The copper or aluminum block 220 is placed substantially adjacent to a thermal contact with an electrically insulating but thermally conductive layer of alumina 219 or at coating such as silicon carbide on copper or anodize coating on the copper or aluminum block 220. The electrically insulating layer 219 is in thermal contact with a thermopile. The thermopile has junctions of Bismuth Telluride semiconductors (alternating doping) and metallic conductors between the heat source and heat sink to create and voltage and current from the temperatures differences between the heat source and the heat sink. Electrical connections 211 on the thermopile deliver electrical power to external applications such as lights, fans, radios, cellular phones, televisions. A heat pipe 229 is thermally connected to the thermopile through an electrically insulating layer 219, such as, for example, an alumina sheet, to remove heat by boiling a working fluid and transferring the heat by condensation to a fined convective and radiating heat sink 22. The heat sink dissipates heat into a fluid as the surrounding convective air flow or body of water such as a in a hot water tank. This heat pipe 229 can be embedded into the structure or machine to maintain temperature in the structure or machine. Within the heat pipe is a wicking material to draw liquid working fluid such as water, methanol, ammonia, or Freon back to the hot boiling surface from the condensation cooler areas.

In FIG. 4, condensation 214 of the working fluid 216 is shown condensing as droplets and with gravity the larger droplets flow down the surface of the condensing surface to return to a reservoir of working fluid 216. The reservoir of working fluid is then in contact with the boiling surface and the wick 213 is also used to move liquid fluid into contact with the boiling surface. The heat flowing from the thermopile boils the working fluid liquid and then travels as a gas to the condensing surface 214 to deliver heat to the heat sink 22 when the working fluid condenses from a gas to a liquid. On the opposite side of the heater, a lower temperature heat removal system thermally coupled to the exterior of the stainless steel cage. Loops of copper or stainless steel tubing 223 can be brazed to a stainless steel cage 206 surrounding the catalytic bed. The working fluid of methanol, methanol and water, ethylene glycol and water, water, ammonia, hydrogen, or Freon can be pumped around the tubing on the stainless steel cage of the catalytic bed. When the working fluid boils it can remove heat at the boiling point of the fluid. If the fluid does not boil it can remove heat at a range of temperature across the surface of the heater as the working fluid temperature is raised and the heat added to the fluid. The pump 28 can be used to change the rate at which the working fluid is circulated. This in turn can deliver heat at different temperatures. If the pump 28 is stopped or slowed the flow is slowed or blocked and the heat delivery is slowed or stopped.

Figure 5:
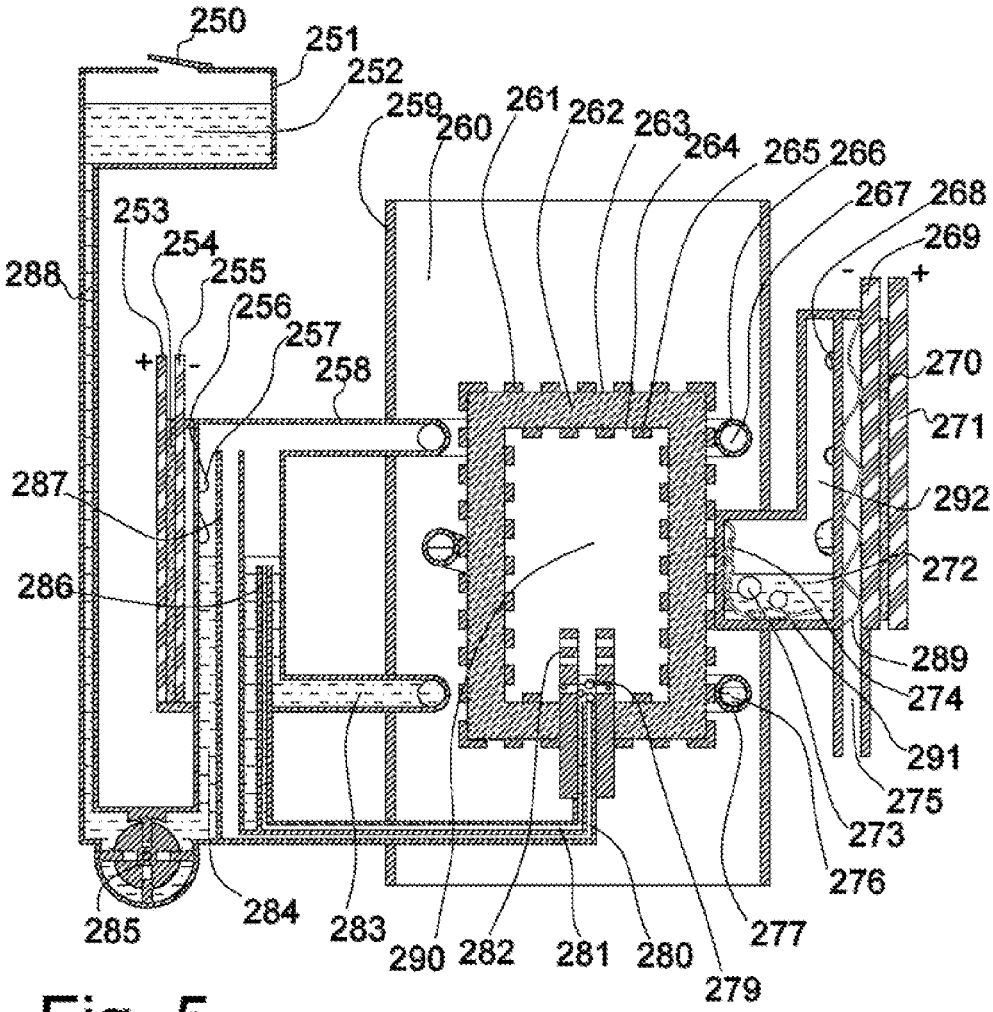
FIG. 5 is an illustration of a cross sectional view of an exemplary embodiment of heat fuel cells according to the present invention.

The fluid loops 203 coming from the catalytic bed pass through a finned or non-finned heat sink 22 outside of the chimney 23 that either condenses working fluid gas or reduced the working fluid temperatures and subsequently delivers heat to the heat sink 22. The heat sink conduct, convect, and radiate heat to the fluids such as air or water. The heat sink could be imbedded in floors, roads, runways, landing pads, walk ways, athletic fields, greenhouses, walls, furniture, air flow ducts, apparel, mirrors, windows, batteries, electronics, machinery, or automobiles, In FIG. 5, the jet heater is configured to heat fuel cells. In this exemplary embodiment, a fuel cell is fueled through a fuel delivery membrane 256, either porous or selectively permeable such as, for example, silicone rubber, that essentially blocks the free flow of liquid though the fuel cell but delivers and controlled rate of fuel delivery over the surface of the fuel cell fuel electrode. The fuel cell includes of the fuel delivery membrane 256, fuel electrode 255, in the form of platinum and ruthenium catalysts on activated carbon granules and electrolyte such as Nafion membrane 254, air electrode 253 such as platinum catalyst on activated carbon granules. The diffusion fed methanol fuel cell used in this example has a performance that is 10 to 30 times higher at 65° C. then at 20° C. It is also important to maintain an elevated temperature of the fuel cell during operation to allow product water to vaporize and leave the fuel cell air electrode 253 at a sufficient rate to avoid product water flooding the air electrode 253 of the fuel cell.

In the case of an alkaline electrolyte fuel cell, the fuel cell temperature can be elevated to prevent carbonate formations in the electrolyte. For solid oxide and carbonate electrolyte fuel cells, one must keep the electrolyte conductivity sufficiently high to be useable. Because the boiling point of the fuel in this embodiment is used and the pressure of the fuel can be set, the condensation point and temperature of the delivered fuel to the fuel cell is set. Other fuels such as methanol and water or ethanol can be used that have higher boiling points, but the condensation point and heat delivery can be set by this effect. When the fuel cell temperature goes above the condensation temperature, the fuel no longer condenses on the membrane and the liquid fuel can boil in the reservoir and be forced back out through a valve 285 to the source reservoir 251. In doing this, the fueling rate is decreased but also the catalytic bed throttles back by not delivering fuel to the porous tubes. The fuel cell operates on the fuel vapor that comes through the fuel delivery membrane 256. This may decrease the power output of the fuel cell and dramatically decrease the heat from the heater and acts like thermostatic heater to the fuel cell. Thus, one should avoid excessive temperatures on the fuel cell and maintaining an optimum temperature in the fuel cell. The fuel is delivered to the catalytic bed cavity through at porous tubes 3 the first is through a capillary tube 6 that delivers liquid fuel to the porous tube exit. The capillary tube 6 sets the delivery rate of fuel to the heater. When temperatures in the capillary tube 6 reach the boiling point of the fuel, the fuel delivery rate will be dramatically decreased when gas instead of liquid is passed through the capillary tube 6. When the fuel boils and is pressurized in the reservoir, the fuel level will decrease as fuel is pushed back into the source reservoir 251 and the fuel level in the heat exchange reservoir goes below the capillary tube 6 to the at least two tubes 281. A flow resistance tube 280 acts as fuel vapor vent to the heat exchange reservoir 284. This allows the heat exchange reservoir 284 to vent through this flow resistance tube 280 to the atmosphere through the jet cavity heater and avoid excessive pressurization.

The vaporization and condensation in the heat exchanger depends on the working fluid having the atmosphere removed from the loops and the heat exchange reservoir. Thus, the vent through the capillary tube 280 is needed as a purge route. The fuel vapor and air that is purged, flows through the porous tubes and is combusted in the catalytic bed cavity and catalytic bed. The diameter and length of the vapor route and liquid route tubes can be selected to set the power output rates between cold fueling and the hot idle rate of the heater due to the contrast in flow rates for the two different fueling routes at different temperatures. The fuel that flows to the porous tubes as the portion that reached the jet as liquid travels preferentially through the porous sides of the porous tube exit. The high temperatures and catalytic properties of the walls of the porous tubes and inlet lines are high enough such that fuels such as methanol decompose to a hydrogen rich gas (or plasma) as they flow through the nozzle into the cavity. This decomposition of fuel further enhances the complete combustion and catalytic reaction of the fuel and oxygen at the cavity wall. The fuel that flows to the porous tubes as the portion that reached the jet as vapor more preferentially enters the cavity through the porous tubes' exit nozzle. The completion of the catalytic burn occurs in the catalytic bed with low oxygen catalytic combustion as the fuel diffuses into the inner surface 264 with the in-diffusion of oxygen from the surrounding air flow in the chimney and is completed with catalytic combustion toward the outside surface of the catalytic bed in an oxygen rich environment from the outside air. The temperature gradient in this situation goes from highest in the catalytic bed cavity or on the inner surface 264 of the catalytic bed to the perimeter of the catalytic bed, when the stainless steel cage 261 and cooling loops remove heat along with radiant cooling and convective cooling by the air flow up the chimney.

Another example of the heater system coupled to a fuel cell is to have a fuel independent heat pipe 274 thermally connected to the exterior cage 261 of the jet cavity heater. In this embodiment, the heat pipe could be a heat pipe 291 with a working fluid such as, for example, Freon, water, ammonia, ethanol, propane, butane, pentane, and methanol.

Within the heat pipe 291, a wicking material such as woven mesh or fiber glass cloth is packed up against the heater interior surface of the heat pipe 291. This acts to wick liquid working fluid to the inner surface of the heat pipe 291. The working fluid boils, moves through the heat pipe as a vapor, and then condenses on the inner surfaces of the heat pipe that is in thermal contact with a fuel cell 289. This delivers heat to the fuel cell. Shown in this illustration the heat pipe 291 is in thermal contact with the fuel manifold 289 of the heat pipe 291. The condensate 268 liquid working fluid then flows down the inner condensing surfaces (for example, attracted by gravity) to return liquid working fluid to the heat pipe reservoir 272. The wicking material could be extended to the condensation surfaces 268 to be able to wick the liquid working fluid against gravity, such as when the fuel cell 289 is below the vertical height of the jet cavity catalytic heater cage contact 262. The fuel cell 289, as an example, could be a hydrogen fueled fuel cell and the manifold 289 is filled with hydrogen gas 275 and fibrous matrix or channels 289 that permit thermal conductivity. These fuel cells 289 could also be electrical conductors making contact with fuel electrode 269 and/or flow routes for the hydrogen gas. It should be mentioned that for hydrogen fuel cells the vent gas diluted with nitrogen from the fuel cell can be terminated into the catalytic cavity 290 to safely combust the hydrogen gas, such as shown in FIG. 1 as an inlet tube 37. The hydrogen fuel cell may include of the fuel manifold 289, gas inlet lines 18, platinum coated activated carbon granular fuel electrodes 269, an electrolyte 270 such as hydrogen ion conductive electrolyte such as Nafion or anion conductive electrolyte such as potassium hydroxide impregnated asbestos mat, platinum coated activated carbon granular air electrode 271.

Figure 6:
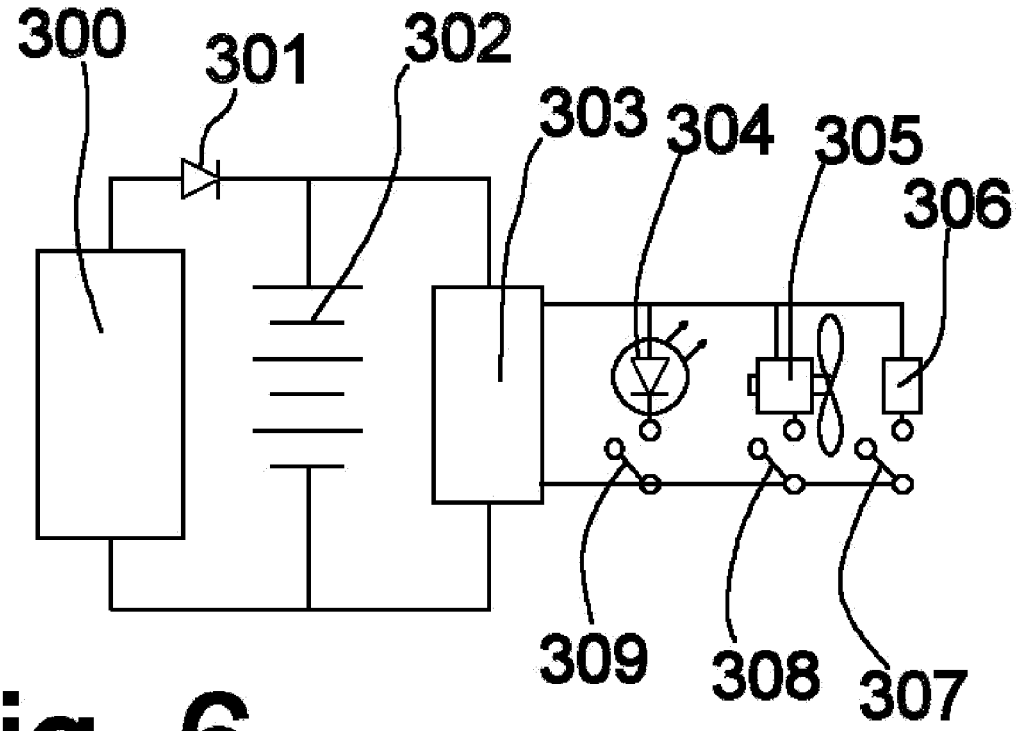
FIG. 6 is an illustration of showing a lighting or appliance system according to an exemplary embodiment of the present invention.

In FIG. 6 the electrical output and interface system is shown. The thermopile, heat to electrical energy converter, and/or fuel cell 300 delivers DC current to the charge a battery or capacitor 302. The direct current output may be moderated or converted through devices such as a DC to DC converter 300 to match the desired charging voltage on the battery or capacitor 302. In particular the high current low voltage of the thermopiles and fuel cells can be converted to high voltage low current through a switched DC current, a step up transformer, and rectifier 300. A check diode 301 is placed in the circuit to prevent back flow of current from the battery or capacitor 302 into the thermopile or fuel cells 300. An electrical power controller 303 is electrically connected to the battery 302 to deliver suitable electricity to appliances such as, for example, light emitting diodes 304, fluorescent lamps, fans, radios 306, televisions, cellular phones, detectors, telephones, and the like. First switch 307, second switch, 308, and third switch 309 are used to control the various appliances.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A catalytic heater comprised of:

one or more fuel reservoirs;

a fuel inlet from which a fuel is able to be discharged comprising (a) one or more fuel supply pipes connected to the one or more fuel reservoirs and (b) one or more porous tubes having one or more exit openings and connected to the one or more pipes a catalytic bed comprising porous catalytic walls having an inner surface and an outer surface with the inner surface defining a cavity, wherein the inner surface surrounds the one or more exit openings of the one or more porous tubes;

wherein the outer surface of the porous catalytic wall is in diffusive contact with an oxidizer gas and the inner surface of the porous catalytic wall is in diffusive contact with the fuel in order to achieve catalytic combustion with fuel discharged from the one or more porous tubes and the catalytic combustion of the oxidizer with fuel occurs on the porous catalytic walls between oxidizer molecules diffusing from outside the porous catalytic walls and a plasma within the cavity diffusing towards the catalytic walls, wherein the plasma is formed from vaporized fuel released via the one or more porous tubes, such that the combustion generates heat;

wherein the one or more exit openings of the one or more porous tubes is in substantial fluid contact with the cavity;

wherein (a) at least a portion of the fuel inlet is in thermal contact with a source of heat and (b) at least a portion of the fuel inlet comprises a diameter and length configured to provide for a restriction and wherein such thermal contact and restriction provide that fuel will vaporize and by greater volume effect reduce fuel flow delivery rate through the tubes and thereby effect temperature-dependent, self-regulation of fuel flow delivery rate from the porous tube into the cavity.

2. The heater according to claim 1, wherein the fuel achieves a state of auto-thermostatic behavior.

3. The heater according to claim 1, wherein the source of heat is provided by fuel combustion within the cavity.

4. The heater according to claim 1, wherein the porous catalytic walls are comprised of a porous matrix of high temperature substrate material and coating of catalytic material.

5. The heater according to claim 4, wherein the porous catalytic walls are contained with matrix cage.

6. The heater according to claim 5, wherein the matrix cage is a thermal conductor capable of fluid circulation.

7. The heater according to claim 1, wherein the porous catalytic walls are comprised of rock wool coated with catalysts selected from the group consisting of platinum, palladium, rhodium, copper, zinc, nickel, iridium, tin, osmium, ruthenium silver, titanium oxide, iron, and transition metals.

8. The heater according to claim 1, wherein the porous catalytic walls are in close proximity to highly catalytic particles.

9. The heater according to claim 1, wherein the one or more porous tubes are vertically oriented to have an exit at a top of the one or more porous tubes.

10. The heater according to claim 1, wherein heat is removed from the heater by conduction contact with the porous catalytic walls.

11. The heater according to claim 1, wherein heat is removed by radiant heat transfer from the porous catalytic walls.

12. The heater according to claim 1, wherein heat is removed by a heat pipe or fluid circulation system.

13. The heater system according to claim 12, wherein the fluid circulation system is comprised of pumps, valves, fluid reservoirs, heat reservoirs, or a combination thereof.

14. The heater according to claim 1, further comprising a thermopile or heat-to-electrical-conversion device in thermal contact with the cavity, porous catalytic walls, or a combination thereof.

15. The heater according to claim 1, wherein, during combustive use, the fuel inlet is heated such that the fuel contained therein is boiling which pressurizes the fuel and pushes the fuel in a direction away from the one or more porous tubes.

16. The heater according to claim 1, wherein the heater is used to heat fuel cells, machinery, thermostatically heat fuel cells, apparel, automobiles, greenhouses, apparel, athletic fields, ship decks, landing pads, walkways, walls, electronics, mirrors, windows, greenhouses, batteries, structures, buildings, air ducts, homes, roadways, or a combination thereof.

17. The heater according to claim 1, wherein the heater is configured to combust gases of hydrogen, carbon monoxide, methane, butane, propane, methanol, ethanol, ether, ethane, pentane, dimethylether.

18. The heater according to claim 1, wherein there heater is configured to combust vent gasses from fuel cells, refineries, or processes that generate non- combustible gasses.

19. The heater according to claim 1, further comprised of thermal actuated valves to permit flow or block flow depending on temperature.

20. The heater according to claim 1, further comprised of fuel filters, air filters, or a combination thereof.

21. The heater according to claim 1, further comprised of heat exchangers on an air exhaust having an air inlet, a fuel inlet, or a combination thereof.

22. The heater according to claim 1, wherein convective air flow in a chimney or fan replenishes oxygen near the porous catalytic walls.

23. The heater according to claim 1, wherein the heater delivers electricity to DC-DC converters, batteries, capacitors, DC-AC converters, voltage regulators, light emitting diodes, motors, fans, switches, radios, televisions, cellular phones, or a combination thereof.

24. The heater according to claim 1, wherein the one or more porous tubes are made of sintered metal, ceramic matrixes, fiber matrixes, capillary tubes, or a combination thereof.

25. The heater according to claim 1, wherein the heater further comprises a starting heater fuel delivery system comprising one or more fuel feed capillary tubes connected to the one or more fuel reservoirs and in fluid contact with the jet cavity and having fuel flow rates determined by fluid flow resistance.

26. The heater according to claim 1, further being comprised of a preheating means adjacent to at least one of the one or more pipes.

27. The heater according to claim 26, wherein the preheating means is in close proximity to, or attached to, a matrix cage as a thermal conductor from the main heater, thereby allowing the preheating means to be shut off, manually or automatically, allowing the heater to preheat its own fuel.

28. The heater according to claim 26, wherein the preheating means includes a fuel restrictor to limit heat output.

29. The heater according to claim 1, wherein the at least one exit opening of the one or more tubes is adjustable to modify associated combustion.

30. The heater according to claim 1, wherein the at least one exit opening of the one or more tubes is pores of sintered metal, ceramic matrix, fiber matrix, or a combination thereof, without another exit opening larger than the pores.

31. The heater according to claim 1, wherein the at least one exit opening of the one or more tubes is a single opening in at least one tube.

* * * * *